US006017033A

United States Patent [19]

Keller

[11] Patent Number: 6,017,033

[45] Date of Patent: Jan. 25, 2000

[54] METHOD OF PLAYING A CASINO GAME

[76] Inventor: Claude Keller, 5905 Walker Ave. Apt. 1, Loves Park, Ill. 61111

[21] Appl. No.: 09/072,968

[22] Filed: May 5, 1998

[51] Int. Cl.[7] ..... A63F 1/00

[52] U.S. Cl. ..... 273/292; 273/143 R; 273/138.2; 273/138.1; 463/6; 463/20; 463/12; 463/13; 463/16

[58] Field of Search ..... 463/6, 20, 12, 463/13, 16; 273/143 R, 292, 138.2, 274

[56] References Cited

U.S. PATENT DOCUMENTS 4,669,731 6/1987 Clarke ..... 463/20
5,560,603 10/1996 Seelig et al. ..... 463/6
5,695,402 12/1997 Stupak ..... 463/20
5,752,882 5/1998 Acers et al. ..... 463/42

*Primary Examiner*—Benjamin H. Layno
*Attorney, Agent, or Firm*—Marshall, O'Toole, Gerstein, Murray & Borun

[57] ABSTRACT

A method of playing a casino game rewards a player for how quickly he can "lose". At the outset, the player is provided with a tote. A timer begins, and the player uses the tote to place wagers in the game. The tote is increased when those wagers win and is decreased when they lose. When the tote is reduced to zero, the timer stops. The time it took the player to reduce the tote to zero is measured against a standard, and the player is rewarded based on that performance. The method is particularly well-suited for use in amusement devices, such as arcade games.

20 Claims, 1 Drawing Sheet

METHOD OF PLAYING A CASINO GAME

CROSS-REFERENCE TO RELATED APPLICATIONS

Not applicable.

STATEMENT REGARDING FEDERAL SPONSORSHIP

Not applicable.

BACKGROUND OF THE INVENTION

Many people enjoy the excitement of casino games such as roulette, blackjack, and craps as they are played in gambling resorts. While one part of the appeal is the possibility of winning money, another part of the appeal rests in the play of the game itself.

Many local governments use gambling laws to restrict the use of casino games. Commonly, a casino game may be played for the entertainment that the game itself provides, but may not be played as a game of chance for winning money. To appeal to players who enjoy such games, it is desirable to find new ways to play traditional casino games.

One problem with traditional casino games is that many people feel that they often "lose" at such games. It is thus also desirable to provide new ways to play such games that will appeal to those people.

BRIEF SUMMARY OF THE INVENTION

The applicant has developed a method of playing a casino game that is exciting to players who enjoy such games, and that may also be appealing to people who feel that they often lose at such games.

The method involves providing a player with a tote or bank that can be used to place wagers in a casino game. As the game is played, the player's tote is increased whenever a wager "wins" and is reduced whenever a wager "loses". A player may continue to play until the entire tote has been "lost", and thus is rewarded by being allowed to continue to play for as long as he or she remains successful. "Unlucky" players are rewarded in a different way. The time that a player is able to play is measured, and the player may be provided with a separate, non-monetary reward based on how quickly he or she "loses" the entire tote.

DETAILED DESCRIPTION OF THE INVENTION

Figure 1:
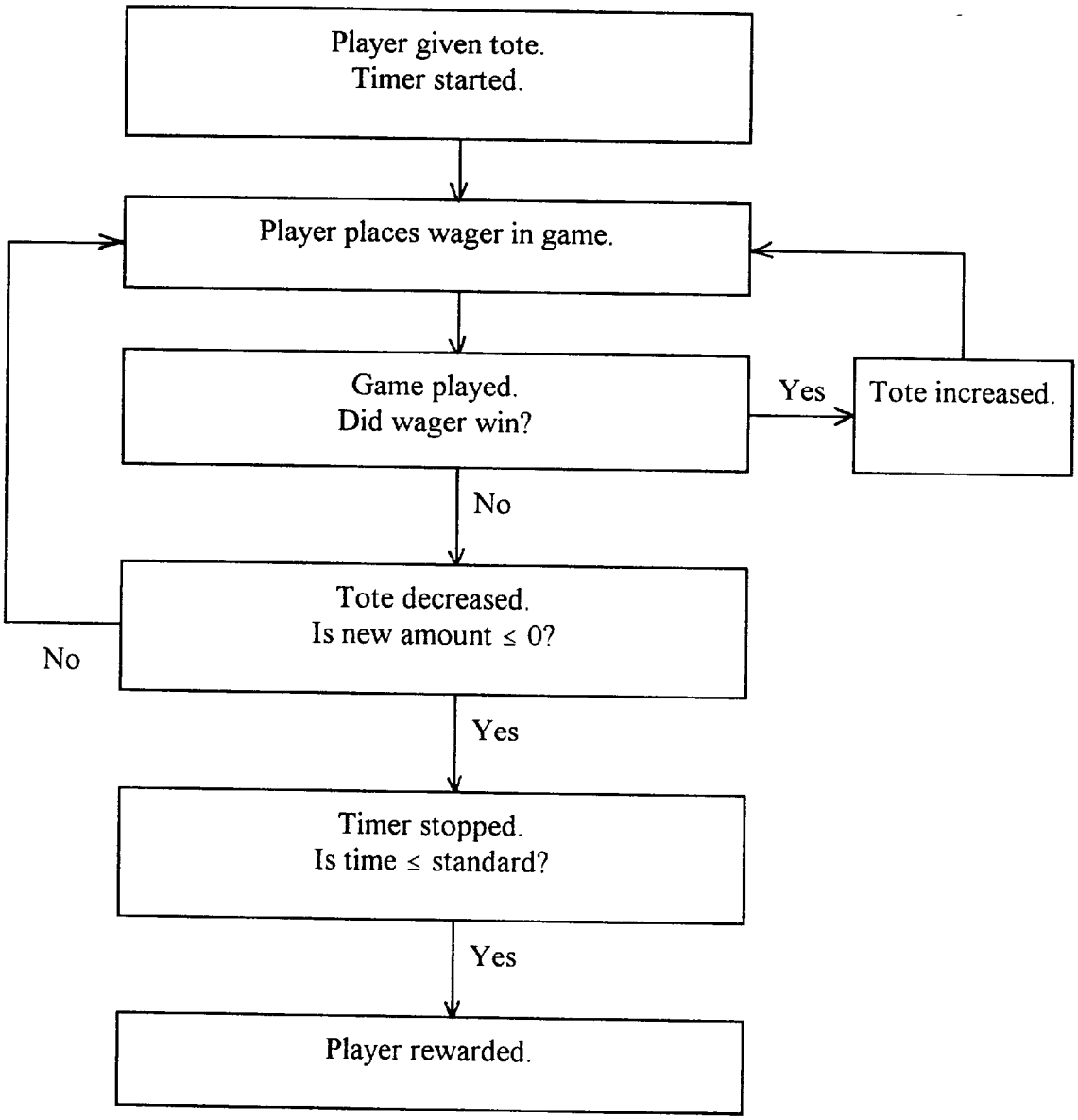
FIG. 1 is a flowchart of the method of the present invention.

The method can be used with any of a variety of traditional casino games, such as blackjack, roulette, or craps. Because casinos make it their business to find and offer the most entertaining games, it is believed that the most entertaining casino games will be those that are most prevalent in casinos. However, any game that is based substantially on such a game, or is reminiscent of or similar in spirit or play action to such a game, or is even promoted as being like such a game, will function as a casino game within the meaning of that term intended here.

Specifically, the method may also be used with electronic or arcade-type casino games, such as slots or video poker.

It is not necessary that the same casino game be provided throughout the method. For example, the player could be given the option of changing casino games throughout the operation of the method, first playing slots, then blackjack, etc.

As seen in FIG. 1, the method begins with a player being provided with a tote or bank: a fund that can be used to place wagers. Preferably, the tote has a numerical value, such as a number of "dollars" or a number of chips. The tote is preferably provided by recording an accounting entry, but it could also be provided by giving the player tokens of some sort, such as chips. It is also preferred that the tote not be redeemable for money, and that this be made clear to the player.

As the method begins, a timer is started. The timer can work in a variety of ways. It can, for example, be a conventional chronological clock, keeping time in seconds or minutes. Alternatively, the timer can be a counter. For example, when the game is a card game played in hands, the timer may count the number of hands dealt. When the game is slots, the timer may count the number of pulls of the lever. The timer could also count the number of wagers placed by the player during the course of play. However, it may be preferable if the timer at least in part takes into account chronological time.

The player may be given an option of selecting one of a variety of casino games. Alternatively, he or she may be restricted to a single game. In either event, once the identity of the game has been determined, the player is given an opportunity to use the tote to place wagers in the game. Preferably, the game is played—except with respect to paying "winning" wagers—according to conventional rules.

In a conventional casino game, the player traditionally places a wager on the outcome of a random event (the spin of a wheel, the draw of a card, the roll of a pair of dice). There are often two types of wagers: "even-money" wagers and "weighted" wagers that take into account predetermined probabilities that certain types of wager will "win". Even-money wagers are those traditionally rewarded with a payoff (when the wager is successful) that is equal to the amount of the wager. For example, a wager on "red" or "black" in roulette is an even-money wager based on the mathematical probability that the wager will be successful about one time in two. Weighted wagers are those in which the payoff (when the wager is successful) is equal to a multiple of the wagered amount. A wager on a particular number in roulette is generally a 30-to-one or 35-to-one wager.

In traditional electronic or arcade-style casino games, players generally do not have the option of making weighted wagers. However, players can win amounts that exceed the amount wagered when improbable or difficult-to-achieve results are achieved. For example, stopping slots reels on a "bar-bar-bar" display generally provides a payout of a large multiple of the wagered amount. Similar multiple payouts are also found in some traditional casino games: for example, paying double when a player is dealt "blackjack".

In the present method, rather than providing a payoff in money (or its equivalent, chips that may be redeemed for money), "winning" wagers result simply in an increase in the players tote. For example, winning a one-unit, even-money wager results in the player's tote being increased by one unit. Winning a two-unit, three-for-one wager results in the player's tote being increased by six units. Winning a ten-to-one payout on a one-unit wager in an electronic or arcade-style casino game results in the tote being increased by ten units.

After recording an increase in the player's tote, the player is provided with another opportunity to place a stake in the same or another game, as another iteration is played.

It is preferred that the player be limited in the amount of the tote that can be wagered in any one wager. However, the player may be allowed to place wagers in various amounts, or may be given the option of placing certain types of wagers in various amounts. When providing a player with an option of making weighted wagers, it may also be preferable to require the player to make at least one even-money wager during each iteration of the game.

It is, of course, possible to further modify the rules of casino games to add interest to the game when played in accordance with this method. However, variation from the rules may make the game less entertaining to those individuals familiar with the traditional rules.

As in traditional casino games, a "losing" wager results in the loss of the wagered amount. After adjusting the player's tote after a losing wager, the tote is checked to see if it has been reduced to zero (or a negative number). If some of the tote still remains, the player continues and is provided with another opportunity to place a stake in the casino game, or, optionally, in a different game.

If the tote has been reduced to zero (or below), the timer is stopped and the player may be rewarded based on how quickly he or she has reduced the tote to zero. Preferably, the reward is based upon a comparison of the player's time with a standard. If the player's time meets the standard (in other words, if the player has lost his or her entire tote fast enough), the player is rewarded. The standard could be a predetermined "time" (such as one minute, or ten hands), but could also be a floating standard. For example, the standard could be the fastest (or second-fastest, or tenth-fastest) time of the day (or week, or month). Alternatively, the method could be used with a number of players playing simultaneously, with the standard being the fastest time of those players.

Again, it is preferable that any reward be non-monetary. Suitable non-monetary awards could include, for example, recognition (such as a posting of the player's name and time) or entry into a separate contest, such as (for example) a skill game in which a cash prize is available.

This method is readily adaptable to use in an amusement device such as an arcade game. In order to utilize the method, the device should be designed to automatically credit a player with a tote once the game is activated. It should incorporate structure or software for conducting a game in which the player has an opportunity to use the tote to place a series of wagers. The device should be designed to credit the player's tote when a stake wins, and to decrease the tote when a stake loses. It should also include structure, such as a clock or counter, to measure the time it takes the player to reduce the tote to zero. Finally, it should include a structure or programming for rewarding the player based on how quickly the player reduces the tote to zero.

Optionally, the device may include structure or programming enabling the player to place wagers in various amounts, to place both even-money and weighted wagers, and to win multiple payouts.

This description of my method for playing a casino game has been only that: a description. Those skilled in the art will appreciate that many modifications can be made to the method without departing from the spirit or scope of the invention, which is set forth in the following claims.

What is claimed is:

1. A method of playing a casino game, comprising the steps of:

providing a player with a tote;

conducting a game in which the player has an opportunity to use the tote to place a series of wagers;

increasing the player's tote when a wager wins and decreasing the tote when a wager loses;

measuring the time it takes the player to reduce the tote to zero; and rewarding the player based on how quickly the player reduces the tote to zero.

2. A method as recited in claim 1, in which the player can place a wager in a variety of amounts, and the amount by which the tote in increased when a wager wins is related to the amount of the wager.

3. A method as recited in claim 1, in which the amount by which the tote is increased when a particular wager wins is related to a predetermined probability that the wager would win.

4. A method as recited in claim 1, in which the amount by which the tote is increased when a particular result is achieved is related to the improbability or difficulty of obtaining that result.

5. A method as recited in claim 1, in which the game is a card game played in hands, and the time it takes a player to lose is measured in the number of hands dealt.

6. A method as recited in claim 1, in which the game is slots, and the time it takes a player to lose is measured in number of pulls of the lever.

7. A method as recited in claim 1, in which the time it takes a player to lose is measured by the number of wagers that are placed.

8. A method as recited in claim 1, in which the player is rewarded if the time in which the tote is reduced to zero is equal to or less than a predetermined time.

9. A method as recited in claim 1, in which multiple players play simultaneously, and the player with the fastest time is rewarded by entry into a separate game.

10. A method of playing a casino game, comprising the steps of:

providing a player with a tote;

conducting a game in which the player has an opportunity to use the tote to place a series of wagers, the rules of the game providing the player with options for placing at least one even-money wager and at least one weighted wager;

decreasing the tote by the amount of the wager when a wager loses, and increasing the tote by the amount of the wager when an even-money wager wins and by a multiple of the wager when a weighted wager wins;

measuring the time it takes the player to reduce the tote to zero; and rewarding the player based on how quickly the player reduces the tote to zero.

11. A method as recited in claim 10, in which:

the player is required place at least one even-money wager during each iteration of the game.

12. An amusement device comprised of:

means for crediting a player with a tote;

means for conducting a game in which the player has an opportunity to use the tote to place a series of wagers;

means for crediting the player's tote when a wager wins and decreasing the tote when a wager loses;

means for measuring the time it takes the player to reduce the tote to zero; and means for rewarding the player based on how quickly the player reduces the tote to zero.

13. A device as recited in claim 12, in which the means for conducting the game enable the player to place a wager in a variety of amounts, and the means for crediting the player's tote comprise means to credit the tote by an amount proportional to the amount of the wager.

14. A device as recited in claim 12, in which the means for crediting the player's tote comprise means to credit the tote by an amount that is related to a predetermined probability that the wager would win.

15. A device as recited in claim 12, in which the device comprises means for conducting a game of slots, and the means for measuring the time it takes a player to reduce the tote to zero comprises means for counting the number of pulls of the lever.

16. A device as recited in claim 12, in which the device comprises means for conducting a card game, and the means for measuring the time it takes a player to reduce the tote to zero comprises means for counting the number of hands dealt.

17. A device as recited in claim 12, in which the means for measuring the time it takes a player to reduce the tote to zero comprises means for counting the number of wagers that are placed.

18. A device as recited in claim 12, further comprising means for comparing the time in which the tote is reduced to zero against a standard time, and the means for rewarding the player rewards the player if the time meets the standard.

19. A device as recited in claim 12, further comprising:

means for enabling multiple players to play simultaneously, each player having a separate tote;

means for comparing the times that it takes the players to reduce their respective totes to zero; and means for rewarding the player with the fastest time.

20. A device as recited in claim 12, in which:

the game includes a variety of possible winning results, some of which are more improbable or difficult to obtain than others; and the means for crediting and decreasing the tote decrease the tote by the amount of the wager when a wager loses, and increase the tote by an amount related to the improbability or difficulty of obtaining a given winning result when a wager wins.

* * * * *